United States Patent [19]

Funada

[11] 4,381,750

[45] May 3, 1983

[54] FUEL INJECTION APPARATUS FOR INTERNAL COMBUSTION ENGINES

[75] Inventor: Takeo Funada, Higashi-Matsuyama, Japan

[73] Assignee: Diesel Kiki Co., Ltd., Saitama, Japan

[21] Appl. No.: 283,519

[22] Filed: Jul. 15, 1981

[30] Foreign Application Priority Data

Jul. 24, 1980 [JP] Japan ..... 55-101947

[51] Int. Cl.[3] ..... F02M 51/00

[52] U.S. Cl. ..... 123/446; 123/447; 123/500; 123/501

[58] Field of Search ..... 123/447, 500, 503, 501, 123/446

[56] References Cited

U.S. PATENT DOCUMENTS

| | | | |
|---|---|---|---|
| 3,516,395 | 6/1970 | Bassot et al. | 123/446 |
| 3,943,901 | 3/1976 | Takahashi et al. | 123/447 |
| 4,089,315 | 5/1978 | Lakra | 123/447 |
| 4,280,464 | 7/1981 | Kanai et al. | 123/447 |
| 4,327,694 | 5/1982 | Henson et al. | 123/503 |

FOREIGN PATENT DOCUMENTS

| | | | |
|---|---|---|---|
| 963294 | 3/1948 | France | 123/500 |
| 266688 | 8/1927 | United Kingdom | 123/503 |

*Primary Examiner*—Charles J. Myhre

*Assistant Examiner*—Magdalen Moy

*Attorney, Agent, or Firm*—Frishauf, Holtz, Goodman and Woodward

[57] ABSTRACT

A fuel injection apparatus for internal combustion engines, which includes a servo piston having a large size portion and a small size portion. The large size portion defines a servo-pressure chamber and a counter-servo-pressure chamber, and the small size portion a pump working chamber, respectively. Operating fluid is supplied from an exclusive pressure feed means to the servo-pressure chamber and the counter-servo-pressure chamber alternately through the action of a solenoid controlled selector valve, while fuel is supplied to the pump working chamber from another pressure feed means provided separately from the firstmentioned pressure feed means. The large size portion of the servo piston has its outer peripheral surface formed with an oblique-base notch opening in its end face facing the servo-pressure chamber. The piston housing has its peripheral wall formed with a spill port which is located for engagement with the oblique-base notch. The compression or delivery stroke of the servo piston varies as the servo piston is rotated. Thus, control of the fuel injection quantity can be effected by changing the circumferential position of the servo piston. The fuel injection beginning can be controlled by changing the timing of change of the valve position of the selector valve.

3 Claims, 4 Drawing Figures

FUEL INJECTION APPARATUS FOR INTERNAL COMBUSTION ENGINES

BACKGROUND OF THE INVENTION

This invention relates to a fuel injection apparatus for internal combustion engines, particularly diesel engines.

Several fuel injection apparatus have so far been proposed, e.g., by Japanese Patent Publication No. 47-38324 and Japanese Provisional Patent Publication No. 50-45124, which each use a servo piston having a large size portion defining a servo-pressure chamber which is intermittently supplied with pressurized fuel used as pressure operating fluid from a pressure feed source by way of a solenoid controlled selector valve to cause reciprocating motion of the servo piston. The reciprocating motion of the servo piston in turn causes compression of fuel in the pump working chamber which has been introduced into the chamber, directly from the above pressure feed source or by way of the above solenoid controlled selector valve, to force the fuel to be injected through an injection nozzle into an engine cylinder.

According to such conventional fuel injection apparatus, fuel, which is to be supplied to the engine, is also used as pressure operating fluid and supplied to the above servo-pressure chamber for causing reciprocating motion of the servo piston. That is, the fuel feed system is used as an operating fluid feed system for the servo piston, too. Fuel generally used in engines is relatively low in viscosity. However, to use such fuel in a hydraulic driving system for the servo piston including the operating fluid feed system under high pressure (e.g., 750 kg/cm$^2$ or more), high lubricativeness and high fluidtightness are required of hydraulic devices used in such hydraulic driving system. If the hydraulic devices are not satisfactory in lubricativeness and fluidtightness, they cannot endure long use. Therefore, to have sufficient durability, the hydraulic devices have to meet special requirements in respect of lubricativeness and fluidtightness, which involves a problem of manufacturing cost.

Further, according to the above-mentioned conventional fuel injection apparatus, the fuel injection end is determined by the extreme compression stroke end point of the servo piston and cannot be electrically controlled. Therefore, if the fuel being supplied to the servo piston is subject to pressure variation, the injection quantity, the injection period, the injection timing, etc. all have to be controlled solely by changing the period and timing of energization and deenergization of the solenoid controlled selector valve. However, in fact setting of the timing of supply of an energization control signal to the selector valve is very difficult, and accordingly an electronic control circuit, which is usually used for control of supply of such control signal, is necessarily complicated in construction or circuit configuration, which is disadvantageous in respect of manufacturing cost and maintenance.

OBJECTS AND SUMMARY OF THE INVENTION

It is an object of the invention to provide a fuel injection apparatus for internal combustion engines, which permits use of oil having relatively high viscosity as pressure operating fluid to ensure sufficient lubricativeness and fluidtightness of the hydraulic devices used therein even with the use of standard type hydraulic devices in the hydraulic driving system for the servo piston, to thereby obtain a long life of the hydraulic devices as well as a reduction in the manufacturing cost.

It is a further object of the invention to provide a fuel injection apparatus for internal combustion engines, which is capable of controlling the fuel injection quantity, the fuel injection beginning and the fuel injection end with ease and accuracy.

It is another object of the invention to provide a fuel injection apparatus for internal combustion engines, which can employ an electronic control circuit having a simple circuit configuration for control of solenoid controlled selector valves used to control feeding of the pressure operating fluid.

According to the invention, the servo piston has a large size portion and a small size portion, the large size portion defining a servo-pressure chamber and a counter-servo-pressure chamber between its opposite end faces and associated inner surfaces of a piston housing within which the piston is mounted, and the small size portion defining a pump working chamber between an end face thereof remote from the large size portion and associated inner surfaces of the piston housing. The large size portion of the servo piston has its outer peripheral surface formed with an oblique-base notch opening in an end face thereof facing the servo-pressure chamber, and the piston housing has its peripheral wall formed with a spill port located for engagement with the above notch. An exclusive operating fluid pressure feed means is connected to the servo-pressure chamber and the counter-servo-pressure chamber. Connected to the pump working chamber are an injection nozzle and a fuel pressure feed means provided separately from and independently of the operating fluid pressure feed means. Further provided are a selector valve means which has its valve position changeable to allow operating fluid to be supplied from the operating fluid pressure feed means to the servo-pressure chamber and the counter-servo-pressure chamber alternately, an actuator connected to the servo piston for rotating same; and means coupling the servo piston to the actuator in a manner allowing free axial displacement of the piston but forcing rotation thereof in unison with the actuator. Control of the fuel injection quantity is effected by rotating the servo piston to change its circumferential position through the actuator to change the compression stroke of the piston correspondingly, while control of the fuel injection timing is effected by changing the timing of change of the valve position of the selector valve means.

The above and other objects, features and advantages of the invention will be more apparent from the ensuing detailed description taken in connection with the accompanying drawings.

DETAILED DESCRIPTION

An embodiment of the invention will now be described in detail with reference to the accompanying drawings.

Figure 1:
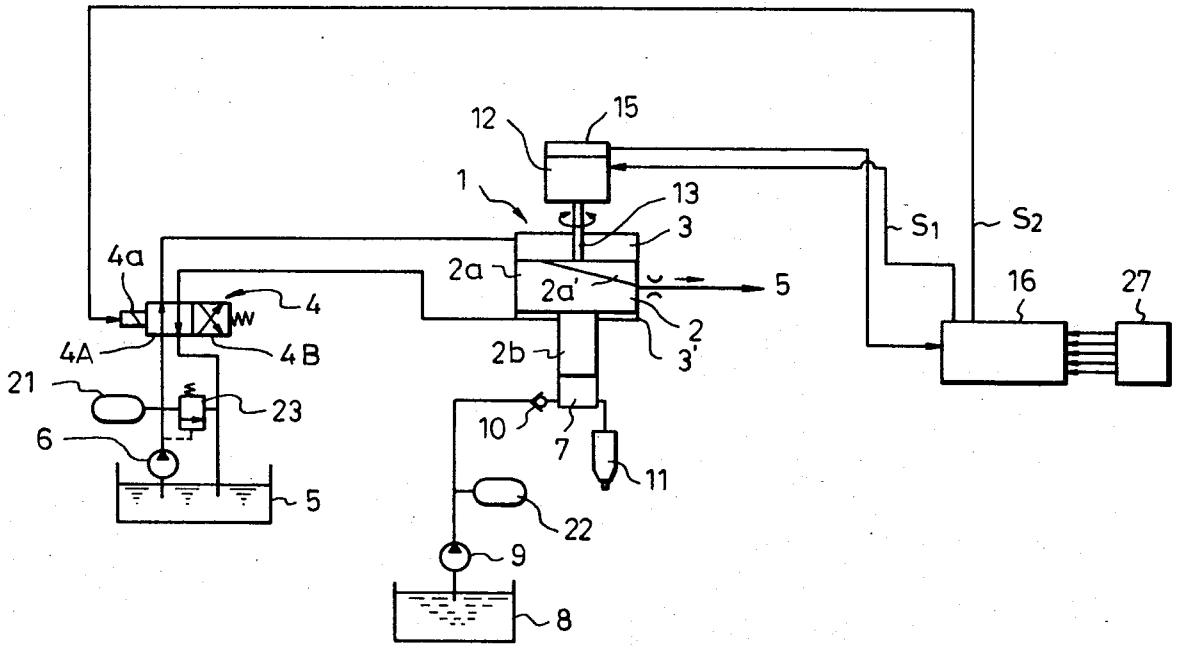
FIG. 1 is a schematic view illustrating the whole arrangement of the fuel injection apparatus according to the present invention.

Referring first to FIG. 1 illustrating the whole arrangement of the fuel injection apparatus of the invention, reference numeral 1 designates a main body within which is arranged a servo piston 1 which is comprised of a large size portion 2*a* relatively large in diameter and a small size portion 2*b* relatively small in diameter. A servo-pressure chamber 3 and a counter-servo-pressure chamber 3' are defined at opposite ends of the large size portion 2*a* of the servo piston 2. A solenoid controlled selector valve 4 is connected to these chambers 3, 3' which chambers are supplied with operating oil stored in an operating oil tank 5 and pressurized by a pump 6, both provided exclusively for these chambers 3, 3'. The oil is fed to the chambers 3, 3' alternately by the action of the selector valve 4. This selector valve 4 is adapted to have its valve position set to position 4A when its solenoid 4*a* is energized, and to position 4B when the solenoid is deenergized, respectively. On the other hand, a pump working chamber 7 is defined by the small size portion 2*b* of the servo piston 2, which chamber is supplied with fuel stored in a fuel tank 8 and fed under pressure to the chamber by means of a pump 9 and through a check valve 10, the tank 8 and pump 9 being provided separately from the aforementioned tank 5 and pump 6. Connected to the pump working chamber 7 is an injection nozzle 11 for injecting fuel fed thereto from the pump working chamber 7, into an engine cylinder, not shown.

The large size portion 2*a* of the servo piston 2 has its outer peripheral lateral formed with a notch 2*a'* which extends from an end edge of the portion 2*a* facing the servo pressure chamber 3 and terminates in the outer peripheral lateral surface of the portion 2*a*, the notch 2*a'* having its base extending obliquely with respect to the axis of the piston 2. An actuator 12 is arranged at a location upward of the servo piston 2, which may comprise a pulse motor, a solenoid controlled actuator or the like and is coupled to the servo piston 2 by means of a rod 13 for rotating the piston 2. Mounted on the actuator 12 is a piston position sensor 15 which may comprise a differential transformer, a potentiometer or the like, for detecting the circumferential position of the actuator 12, i.e., that of the servo piston 2.

The position sensor 15 is electrically connected to an electronic control circuit 16 for supplying its output signal thereto. The electronic control circuit 16 is also electrically connected to the actuator 12 and the solenoid 4*a* of the selector valve 4, for controlling their operations. An engine operating condition detecting device 27 is connected to the control circuit 16, which comprises a plurality of sensors, not shown, which are arranged to detect engine rpm, top-dead-center position of an engine cylinder piston, engine temperature, atmospheric pressure, engine load, etc., respectively and supply their respective output signals to the control circuit 16. The control circuit 16 is programmed to supply control signals responsive to the output signals of the sensors 15, 27, to the actuator 12 and the selector valve 4 to drive them so as to control the fuel injection quantity and the fuel injection beginning to respective optimum values.

In FIG. 1, reference numerals 21, 22 designate accumulators for temporarily storing fuel pressurized by the respective pumps 6, 9, and reference numeral 23 a relief valve, respectively.

Figure 2:
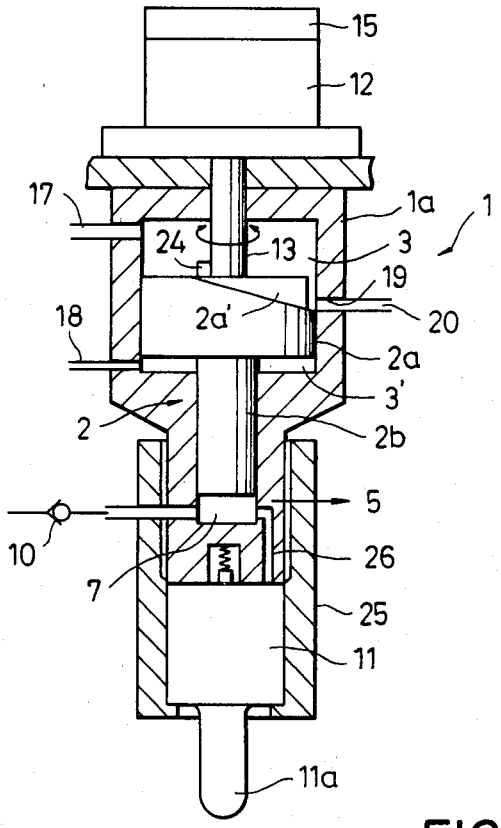
FIG. 2 is a sectional view illustrating in detail the servo piston and its surrounding parts of the apparatus of the invention.
Figure 3:
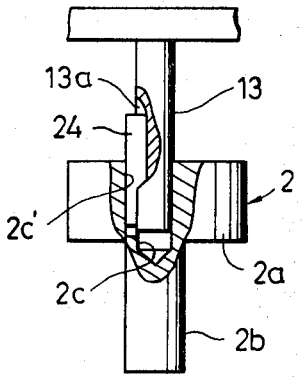
FIG. 3 is a sectional view illustrating the large size portion of the servo piston, with parts broken away.

FIGS. 2 and 3 illustrate in detail the main body 1 of the fuel injection apparatus shown in FIG. 1. The main-body 1 has a piston housing 1*a* which has its peripheral wall provided with oil conduits 17, 18 opening, respectively, in the servo-pressure chamber 3 and the counter-servo-pressure chamber 3' defined by the opposite ends of the large size portion 2*a* of the servo piston 2 and associated inner surfaces of the walls of the piston housing 1*a*. The oil conduits 17, 18 communicate with the solenoid controlled selector valve 4 in FIG. 1. The piston housing 1*a* has its peripheral wall formed with a spill port 19 located at an axially predetermined position, which communicates with the operating oil tank 5 in FIG. 1. The servo piston 2 and the actuator 12 are coupled together by means of the rod 13, as previously mentioned. The servo piston 2 is prohibited from being circumferentially displaced relative to the rod 13 but allowed to be freely displaced in the axial or vertical directions. More specifically, as illustrated in detail in FIG. 3, the large size portion 2*a* of the servo piston 2 is formed with a bore 2*c* opening in its upper end face and extending along its axis. The rod 13 has its one end secured to the rotary shaft, not shown, of the actuator 12 and its other end portion slidably inserted in the above 2*c*. A key member 24 is force fitted at its one side in an axial slit 2*c'* formed in the peripheral wall of the above bore 2*c* in the large size portion 2*a* of the servo piston 2, and fitted at its other side in an axial groove 13*a* formed in the outer peripheral surface of the rod 13 in a manner permitting vertical sliding movement of the rod 13 in the groove 13*a*.

The position of the above spill port 19 determines the compression or fuel delivery stroke of the servo piston. That is, when the oblique base or lower or bottom edge of the notch 2*a'* encounters the upper edge of the spill port 19 during the descending or compression stroke of the servo piston 2, the pressurized operating oil in the servo-pressure chamber 3 is discharged through the bore 19 and returned to the operating oil tank 5 in FIG. 1 through a conduit 20 connected to the bore 19, to relieve the chamber 3 of its pressurized state, stopping the descending motion of the piston 2. Therefore, by rotating the servo piston 2 by means of the actuator 12 to change its circumferential position, the delivery stroke of the piston 2 or the injection quantity can be varied.

The injection nozzle 11, previously referred to, is supported by a support member 25 threadedly fitted on the lower end portion of the piston housing 1*a*. This injection nozzle comprises an ordinary type automatic injection valve, of which the injection hole portion 11*a* communicates with the pump working chamber 7, which is defined by an end face of the small size portion 2*b* of the servo piston 2 remote from the large size portion 2*a* and its associated inner surfaces of the walls of the piston housing 1*a*, by way of a communication passage 26 formed in the housing 1*a* so that the injection nozzle 11 is actuated by the pressure within the chamber 7 to carry out fuel injection.

The operation of the fuel injection apparatus of the invention arranged as above will now be described.

The electronic control circuit 16 compares the values of the output signals of the engine operating condition detecting device 27, indicative of the operating condition of the engine (engine rpm, engine load, etc.), with data stored therein, to supply a control signal S1 to the actuator 12 to rotate it to an angular or circumferential position corresponding to an injection quantity appropriate to the actual engine operating condition. The output value of the piston position sensor 15 may be used as a feedback signal to determine the angle through which the actuator 12 is to be rotated. Further, the electronic control circuit 16 is also responsive to a top-dead-center position signal outputted from the detecting device 27, indicative of the top-dead-center position of the piston within an engine cylinder, in addition to the above signals indicative of other factors of the engine operating condition, to produce and supply a control signal S2 to the solenoid controlled selector valve 4 when the engine cylinder piston is at a predetermined position relative to the top-dead-center position. The selector valve 4 has its solenoid 4*a* energized by the above signal S2 to be changed to its position 4A to allow the pressurized oil to be supplied from the operating oil tank 5 to the servo-pressure chamber 3 to cause the servo piston 2 to be downwardly moved. The timing of supply of the control signal S2 to the valve 4 is varied mainly as a function of the actual engine rpm. On this occasion, the operating oil in the counter-servo-pressurechamber 3' is returned to the operating oil tank 5 via the selector valve 4. As the servo piston 2 is thus downwardly moved, the fuel, which has been introduced into the pump working chamber 7 from the fuel tank 8 through the pump 9, the accumulator 22 and the check valve 10, is compressed by the small size portion 2*b* of the piston 2 to be injected into the engine cylinder through the injection nozzle 11.

During the above descending stroke of the servo piston 2, when the oblique base or lower edge of the notch 2*a'* of the piston 2 encounters the upper edge of the opening of the spill port 19, the operating oil in the servo-pressure chamber 3 is exhausted through the port 19 into the tank 5, interrupting the descending motion of the piston 2.

Figure 4:
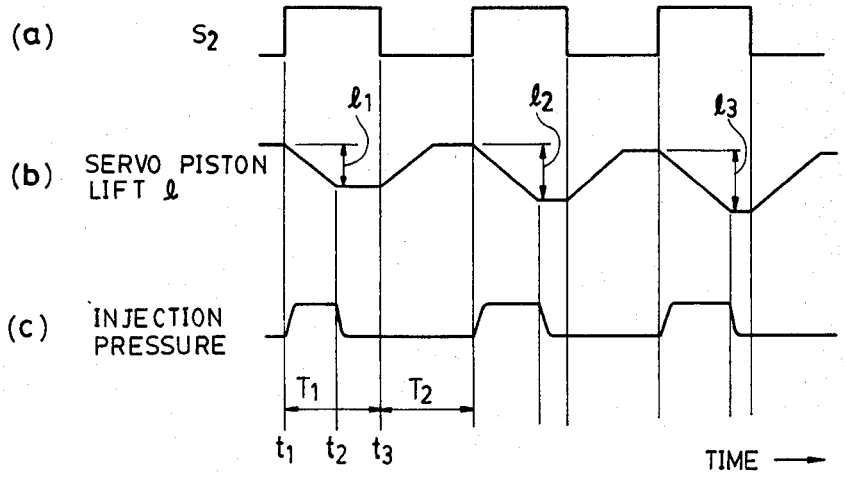
FIG. 4 is a graph illustrating an exemplary operation of the apparatus according to the invention.

Referring to FIG. 4, the relationship is illustrated between the timing of change of the valve position of the selector valve 4, the lift of the servo piston 2, and the injection pressure. According to the figure, when the control circuit 16 causes energization of the selector valve 4 by applying the control signal S2 thereto at a time t1 (FIG. 4 (*a*)), the valve 4 is changed to position 4A to cause operating oil to be supplied to the servo-pressure chamber 3, while simultaneously allowing the operating oil in the counter-servo-pressure chamber 3' to be returned to the tank 5 through the valve 4. Consequently, the servo piston 2 is downwardly moved (FIG. 4 (*b*)) to compress the fuel in the pump working chamber 7 to force it to be injected through the injection nozzle 11 (FIG. 4 (*c*)). Then, when the lower edge of the notch 2*a'* meets the upper edge of the opening of the bore 19 at a time t2, the descending motion of the servo piston 2 is interrupted (FIG. 4 (*b*)), thus causing termination of the injection of fuel through the injection nozzle 11 (FIG. 4 (*c*)). At a time t3, supply of the control signal S2 to the selector value 4 is interrupted to deenergize the valve 4 so that operating oil is supplied to the counter-servo-pressure chamber 3' and simultaneously the operating oil in the servo-pressure chamber 3 is returned to the tank 5. Accordingly, the servo piston 2 is upwardly moved until it is stopped at its top-dead-center position (FIG. 4 (*b*)). In the above-mentioned manner, fuel injection is controlled by controlling the timing of change of valve position of the selector valve 4 in a predetermined manner. The timing of initiation of supply of the control signal S2 to the selector valve 4, that is, the timing of energization of the valve 4 is varied mainly as a function of the actual engine rpm so as to achieve a desired injection beginning.

With the arrangement of the invention, either the on-state period of time T1 or the off-state period of time T2 of the control signal S2 can be set at a constant value so that the energization period of time or the deenergization period of time of the selector valve 4 is set at a constant value, accordingly. That is, the on-state period of time T1 has only to be set at a value corresponding to the period of time in which the servo piston 2 can execute its stroke. Whilst, the period of time T2 has only to be set at a value corresponding to the period of time in which the pump working chamber 7 can be charged with fuel to its full capacity.

With either one of the periods of time T1 and T2 thus set at a constant value, the injection quantity and the injection end are automatically determined by the circumferential position of the servo piston 2. According to the example of FIG. 4, it is to be noted that the lift l of the servo piston 2 varies in a manner indicated by the symbols $l_1$–$l_3$ as the servo piston 2 is varied in circumferential position in dependence upon the control signal S1 (FIG. 4 (*b*)) so that the injection quantity is just increasing (FIG. 4 (*c*)). By virtue of this manner of operation, even if there is a change in the oil pressure at which the relief valve 23 is actuated or the fuel pressure at which another relief valve, not shown, is actuated, which is provided for relieving the fuel pressure being suppliedto the pump working chamber 7 from the fuel tank 8 through the pump 9, it is possible to control the injection end and the injection quantity with ease and accuracy with no influence of such pressure change, merely by changing the circumferential position of the servo piston 2 to appropriate positions. Incidentally, control of the injection beginning can be easily effected by changing the timing of applying the control signal S2 to the selector valve 4.

The fuel injection apparatus according to the present invention arranged as above can produce excellent results such as follows:

a. By virtue of the provision of the feed system of operating oil for driving the servo piston in a manner separate from or independently of the fuel feed system for feeding fuel to the pump working chamber, operating oil having relatively high viscosity can be used to easily obtain sufficient lubricativeness and oiltightness, resulting in a longer life of the hydraulic devices. Further, this can dispense with the use of expensive special hydraulic devices, thus leading to a reduction in the manufacturing cost.

b. Due to the formation of a notch having an obliquely extending base or bottom edge in the large size portion of the servo piston and a spill port in the piston housing in a manner engageable with each other, the injection quantity, the injection beginning and the injection end can be easily controlled merely by rotating the servo piston to appropriate positions.

c. Thanks to the arrangement and results mentioned in the paragraph b, either one of the energization period of time and deenergization period of time of the solenoid controlled selector valve provided in the servo piston driving system for control of the supply of operating oil can be set at a constant value, which makes it possible to design the electronic control circuit to be simple in configuration and therefore further reduce the manufacturing cost.

Obviously many modifications and variations of the present invention are possible in the light of the above teachings. It is therefore to be understood that within the scope of the appended claims, the invention may be practiced otherwise than as specifically described.

What is claimed is:

1. A fuel injection apparatus for use in an internal combustion engine, which comprises:

a piston housing;

a servo piston having a large size portion having opposite end faces, and a small size portion having an end face remote from said large size portion, said large size portion defining a servo-pressure chamber and a counter-servo-pressure chamber between said opposite end faces thereof and associated inner surfaces of said piston housing, said small size portion defining a pump working chamber between said end face thereof remote from said large size portion and associated inner surfaces of said piston housing;

said servo piston having an outer peripheral surface thereof formed with a notch, said notch opening in an end face of said servo piston facing said servo-pressure chamber and having a base thereof extending obliquely to the axis of said servo piston, said piston housing having a peripheral wall thereof formed with a spill port communicating with a zone under lower pressure, said spill port being located for engagement with said notch;

injection nozzle means arranged in communication with said pump working chamber;

means for feeding operating fluid under pressure to said servo-pressure chamber and to said counter-servo-pressure chamber;

selector valve means connecting said servo-pressure chamber and said counter-servo-pressure chamber to said operating fluid pressure feed means and being changeable in valve position to allow operating fluid to be alternately supplied from said operating fluid pressure feed means to said servo-pressure chamber and to said counter-servo-pressure chamber;

means for feeding fuel under pressure to said pump working chamber, said fuel pressure feed means being provided separately from and independently of said operating fluid pressure feed means;

actuator means connected to said servo piston for rotating same; and means coupling said servo piston to said actuator means in a manner allowing free axial displacement of said servo piston but forcing rotation thereof in unison with said actuator means;

whereby rotation of said servo piston to change a circumferential position thereof through said actuator means causes a change in the compression stroke of said servo piston to thereby achieve control of the injection quantity of fuel through said injection nozzle means, while achieving control of the timing of injection beginning of fuel through said injection nozzle means by changing the timing of change of the valve position of said selector valve means.

2. The fuel injection apparatus as claimed in claim 1, wherein said means coupling said servo piston to said actuator means comprises a rod member having one end thereof secured to said actuator means; and means engaging the other end of said rod member with said servo piston in a manner allowing axial movement of said servo piston but prohibiting circumferential movement thereof.

3. The fuel injection apparatus as claimed in claim 1, further comprising: first sensor means for detecting an operating condition of said engine; second sensor means for detecting the circumferential position of said servo piston; and electronic control means electrically connected to said selector valve means, actuator means, first sensor means and second sensor means, said electronic control means being responsive to output signals of said first and second sensor means to cause said actuator means to rotate said servo piston for control of the injection quantity of fuel through said injection nozzle means and change the timing of change of the valve position of said selector valve means for control of the timing of the injection beginning of fuel through said injection nozzle means.

* * * * *